US007677961B2

(12) United States Patent
DeCastro et al.

(10) Patent No.: US 7,677,961 B2
(45) Date of Patent: Mar. 16, 2010

(54) FUME HOOD DRIVE SYSTEM TO PREVENT COCKING OF A SASH

(75) Inventors: Eugene A. DeCastro, Jamestown, NY (US); Ronald Arredondo, Jr., Jamestown, NY (US); Jared Lowe, Lakewood, NY (US); Chad Lucks, Greensboro, NC (US)

(73) Assignee: JMP Aquisition Corp., Jamestown, NY (US)

( * ) Notice: Subject to any disclaimer, the term of this patent is extended or adjusted under 35 U.S.C. 154(b) by 0 days.

(21) Appl. No.: 11/240,248

(22) Filed: Sep. 30, 2005

(65) Prior Publication Data

US 2008/0009234 A1 Jan. 10, 2008

Related U.S. Application Data

(60) Provisional application No. 60/614,534, filed on Sep. 30, 2004.

(51) Int. Cl.
*B08B 15/02* (2006.01)
*B08B 15/00* (2006.01)
*B05C 15/00* (2006.01)

(52) U.S. Cl. ..... 454/56; 454/49; 49/360

(58) Field of Classification Search ..... 454/49, 454/56, 58, 59, 61, 62, 63; 49/361, 360; 16/194; 474/84; 187/315, 324, 334
See application file for complete search history.

(56) References Cited

U.S. PATENT DOCUMENTS 2,254,150 A * 8/1941 Kingsland ..... 49/27
2,339,570 A * 1/1944 Jackson ..... 160/202
2,699,688 A * 1/1955 Sutton ..... 474/86
2,898,607 A * 8/1959 McGuire ..... 4/502
3,254,588 A * 6/1966 Truhan ..... 454/58
4,142,458 A * 3/1979 Duym ..... 454/56
4,150,606 A 4/1979 Nelson ..... 98/115 LH (Continued)

FOREIGN PATENT DOCUMENTS

JP 08024673 A * 1/1996

*Primary Examiner*—Steven B McAllister
*Assistant Examiner*—Patrick F. O'Reilly, III
(74) *Attorney, Agent, or Firm*—The Bilicki Law Firm, PC; Byron A. Bilicki, Esq.; Rebecca M. K. Tapscott, Esq.

(57) ABSTRACT

A fume hood comprised of first and second side walls, a back wall, a work surface, and a top wall, the walls and work surface defining a work area, an access opening for providing a user access to the work area, a movable sash member disposed for vertical movement across the access opening, and an anti-cocking drive mechanism mechanically coupling a drive motor to the movable sash member. The anti-cocking drive mechanism is comprised of a first and a second forward friction wheel, a first flexible coupling mechanically engaging, either directly or indirectly, the first forward friction wheel and a first rear friction wheel and coupled to the movable sash member on one end, a second flexible coupling mechanically engaging the second forward friction wheel and a second rear friction wheel and to the movable sash member on one end, and a drive shaft connecting the first components to the second components such that each are rotated simultaneously by the drive motor and the sash member is raised and lowered evenly on both sides.

3 Claims, 9 Drawing Sheets

U.S. PATENT DOCUMENTS

| | | | | | |
|---|---|---|---|---|---|
| 4,377,969 | A | | 3/1983 | Nelson | 98/115 LH |
| 4,502,375 | A | | 3/1985 | Hignite et al. | 98/115.3 |
| 4,594,742 | A | | 6/1986 | Zeigler et al. | 4/607 |
| 4,667,353 | A | | 5/1987 | Zeigler et al. | 4/607 |
| 4,744,878 | A | | 5/1988 | Riggs, Jr. | 204/293 |
| 4,774,878 | A | * | 10/1988 | Berlin et al. | 454/56 |
| 5,216,782 | A | | 6/1993 | Schenck et al. | 16/194 |
| 5,241,788 | A | | 9/1993 | Buie | 49/95 |
| 5,303,659 | A | | 4/1994 | Berlin et al. | 108/50 |
| 5,312,297 | A | * | 5/1994 | Dieckert et al. | 454/238 |
| 5,323,570 | A | * | 6/1994 | Kuhlman et al. | 49/360 |
| 5,382,192 | A | | 1/1995 | Hoffman | 454/61 |
| 5,566,736 | A | * | 10/1996 | Crider et al. | 160/121.1 |
| 5,688,168 | A | * | 11/1997 | Schlies | 454/56 |
| 5,759,096 | A | | 6/1998 | Berlin et al. | 454/56 |
| 5,819,878 | A | * | 10/1998 | Barrett et al. | 187/324 |
| 6,024,638 | A | | 2/2000 | Berlin et al. | 454/56 |
| 6,814,658 | B1 | * | 11/2004 | Rindoks et al. | 454/63 |
| 2003/0089461 | A1 | * | 5/2003 | Dondlinger | 160/84.06 |

* cited by examiner

FUME HOOD DRIVE SYSTEM TO PREVENT COCKING OF A SASH

CROSS-REFERENCE TO RELATED APPLICATIONS

This application claims the benefit of and priority to U.S. provisional application No. 60/614,534 filed Sep. 30, 2004, incorporated herein in its entirety.

FIELD OF INVENTION

The present invention relates generally to a mechanical system that allows an operator to open and close a fume hood movable sash member without cocking the sash. Specifically, the present invention relates to a drive system that simultaneously raises both ends of the movable sash member to prevent it from cocking, whether moved by the drive system or manually.

DETAILED DESCRIPTION OF EMBODIMENTS OF THE INVENTION

For the purpose of promoting an understanding of the present invention, reference will be made to embodiments of a fume hood as illustrated by the following drawings. It will nevertheless be understood that no limitations of the scope of the invention are thereby intended by such alterations as (I) changing the geometry or any element of the embodiments of the invention, (II) the placement of the various components, or (III) the quantity of each component. It is contemplated that such alterations fall within the spirit and scope of the invention described herein. Some of the possible alterations will be mentioned in the following description.

With particular reference to the drawings, the reader should understand that like numerals in different figures refer to the same elements of the various embodiments.

Figure 1:
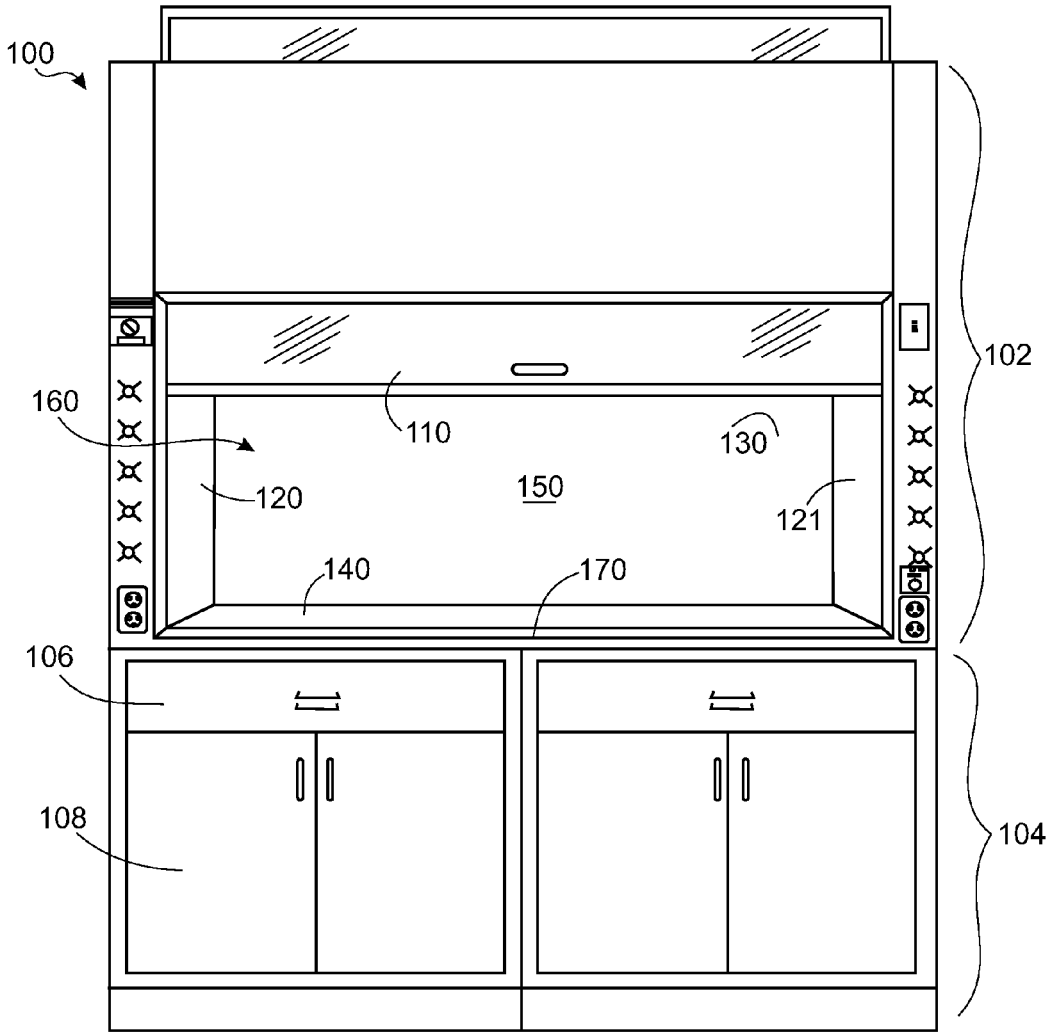
FIG. 1 shows a front view of an exemplary fume hood.

FIG. 1 shows a front view of an exemplary fume hood 100. Fume hood 100 is shown with movable sash member 110 in a partially open position. Fume hood 100 is generally comprised of hood portion 102 and base portion 104. Base portion 104 is, in this embodiment, comprised of two (2) drawers 106 and four (4) cabinets 108. However, this is not intended to be limiting. Rather, any number of drawers 106 and/or cabinets 108, or any style base portion 104 can be used. A solid pedestal or a base with an opening generally centered that provides a user sitting in a chair or wheel chair access to the fume hood are just two examples of alternate base portions that can be combined with hood portion 102. These elements are common to fume hoods and are not intended to limit the invention to any specific type of fume hood, except one in which movable sash member 110 is used.

Also visible in FIG. 1 are first and second side walls 120, 121, back wall 130, and work surface 140. Work surface 140 can be the upper surface of base portion 104 or a separate layer, as is commonly known in the art. They, along with a top wall (not visible) define work area 150. Access opening 160 allows a user to access work area 150 and work surface 140. Movable sash member 110 vertically translates along access opening 160 and provides access to work area 150 and work surface 140 when in the raised position (as shown). When in the down position, movable sash member 110 abuts sill 170 and restricts access to work area 150 and work surface 140.

Movable sash member 110 is shown as a single component. However, it should be understood that it is intended that the invention include embodiments in which the vertically movable sash member 110 further includes horizontally-sliding portions, a collapsing movable sash member, multiple horizontally telescoping movable sash members, and a walk-in type fume hood in which the sash provides access to a walk-in workspace instead of work surface 140, which will be discussed in greater detail infra, or any other type of movable sash member 110 that includes a vertically translating portion.

Figure 2:
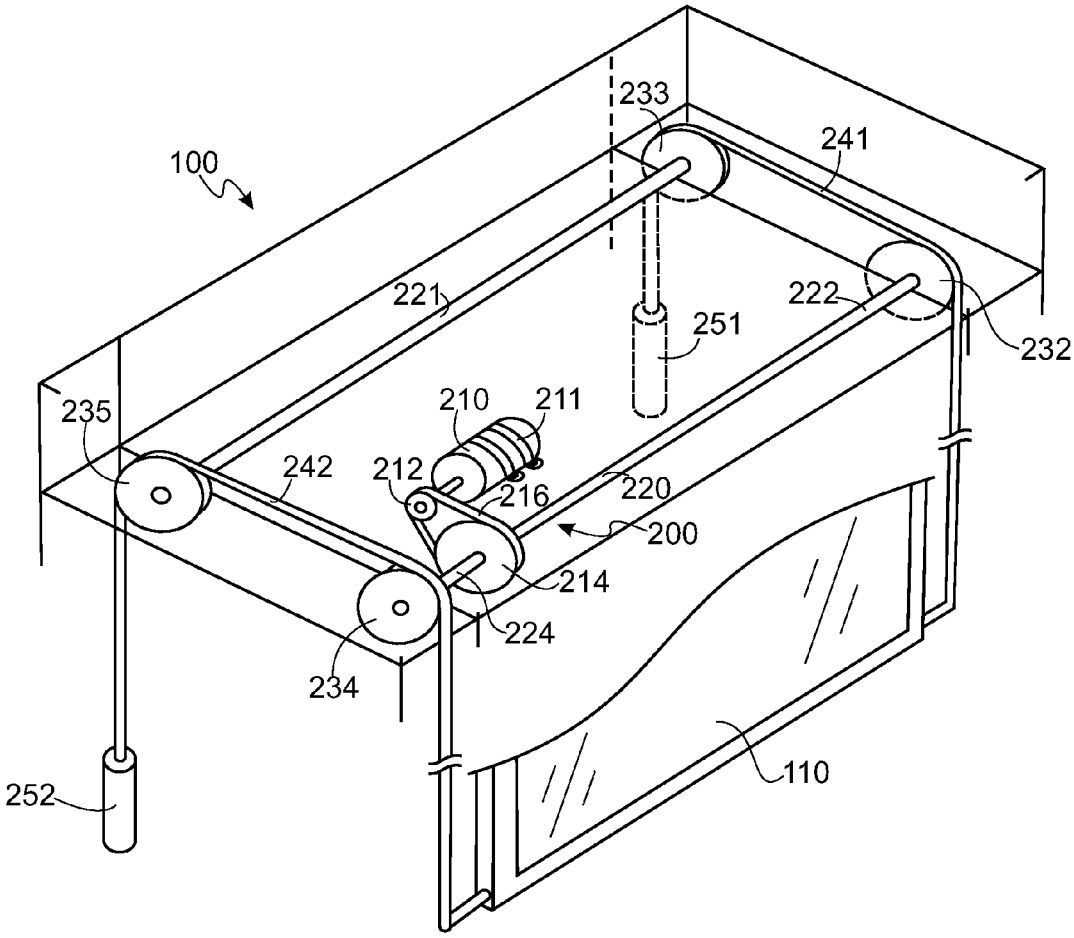
FIG. 2 shows a top perspective view of a fume hood in which one embodiment of the anti-cocking drive mechanism can be viewed.

FIG. 2 shows a top perspective view of fume hood 100 in which one embodiment of anti-cocking drive mechanism 200 can be seen. In this embodiment, anti-cocking drive mechanism 200 is comprised of motor 210 secured to the top surface of fume hood 100, first drive wheel 212, second drive wheel 214, drive shaft 220, first forward friction wheel 234, and second forward friction wheel 232. Motor 210 can be an electrical motor, a gasoline motor, a battery-operated motor, a pneumatic motor (which is especially applicable for applications in which hazardous fumes or liquids are present because a pneumatic motor reduces the possibility of igniting the fumes or liquids), or any other motor known to those of ordinary skill in the art. In the embodiment shown, motor 210 is a 1/50 hp motor, model number 3IK156N-AWU, as manufactured by Oriental Motor, that operates at 1450 rpm at 14.6 ounce-inches. As can also be seen, motor 210 is secured to the top surface of fume hood 100 using two (2) straps 211. However, one of ordinary skill in the art will recognize that any securing mechanism, including an alternate number of straps 211, can be used to secure motor 210 to fume hood 100.

In this embodiment, second drive wheel 214 is mounted on drive shaft 220 (as described in greater detail infra). Drive shaft 220 is connected on first end 224 to first forward friction wheel 234 and on second end 222 to second forward friction wheel 232 such that as drive shaft 220 rotates, first forward friction wheel 234 and second forward friction wheel 232 rotate simultaneously and evenly. First forward friction wheel 234, second forward friction wheel 232, first rear friction wheel 235, and second rear friction wheel 233 can be mounted to fume hood 100 by any means known in the art.

First flexible coupling 242 engages and partially wraps around first forward friction wheel 234 and first rear friction wheel 235 and is secured to first counterweight 252 on one end and to movable sash member 110 on the second end. Second flexible coupling 241 engages and partially wraps around second forward friction wheel 232 and second rear friction wheel 233 and is secured to second counterweight 251 on one end and to movable sash member 110 on the second end. First counterweight 252 and second counterweight 251 are not absolutely necessary, but they balance the weight of movable sash member 110 so that essentially only the friction between first flexible coupling 242 and second flexible coupling 241 and the various friction wheels and drive wheels and the gears' and friction wheels' resistances to movement must be overcome to change the position of movable sash member 110, rather than having to overcome the weight of movable sash member 110. In addition, because first flexible coupling 242 and second flexible coupling 241 operate simultaneously, they may both be coupled to the same counterweight, as described infra.

As motor 210 is operated, first drive wheel 212 is rotated, which, in turn, rotates second drive wheel 214 via motor flexible coupling 216. As second drive wheel 214 rotates, because second drive wheel 214 is fixedly secured to drive shaft 220, drive shaft 220 is rotated along with first forward friction wheel 234 and second forward friction wheel 232. First forward friction wheel 234 and second forward friction wheel 232 thus rotate evenly. As first forward friction wheel 234 and second forward friction wheel 232 rotate, first flexible coupling 242 and second flexible coupling 241 are moved and movable sash member 110 is either raised or lowered such that both ends of movable sash member 110 are raised or lowered simultaneously, preventing movable sash member 110 from cocking and potentially locking within the access opening (not shown) or within a sash guide (not shown) if used. This is one type of anti-cocking drive mechanism 200, i.e., the manner in which drive motor 210 simultaneously and evenly imparts rotation on first forward friction wheel 234 and second forward friction wheel 232 such that both ends of movable sash member 110 are raised and lowered evenly. Alternate embodiments of the anti-cocking drive mechanism will be described infra.

As used herein, "flexible coupling" refers to a chain, a band, a belt, a rope, or any other material well-known to those of ordinary skill in the art which provides sufficient strength and flexibility for proper operation, as discussed. In one embodiment, first and second flexible couplings 242, 241 are an ANSI number 35 roller chain with a ⅜" pitch. However, one of ordinary skill in the art will recognize that other types of chains or other flexible couplings can be used. The term "friction wheel" refers to a generally circular and rotatable wheel that changes the direction of the flexible coupling and around which the flexible coupling passes. In one alternate embodiment, friction wheel is a sprocket as manufactured by US Tsubaki, part number P/N 35B24F and the flexible coupling is a chain, as manufactured by US Tsubaki, part number RS35.

Figure 3:
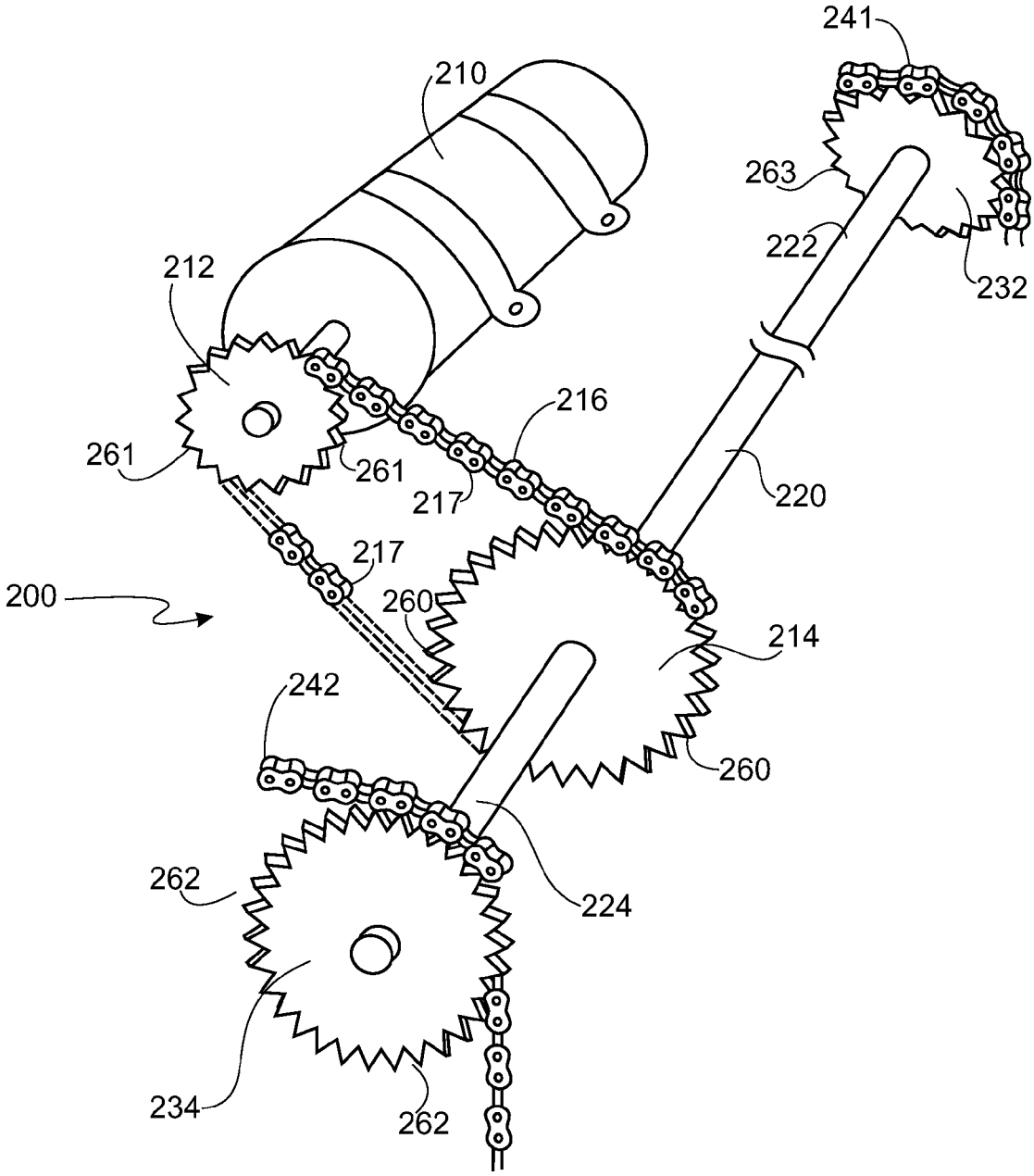
FIG. 3 shows an enlarged top perspective view of one embodiment of the anti-cocking drive mechanism shown in FIG. 2.
Figure 4A:
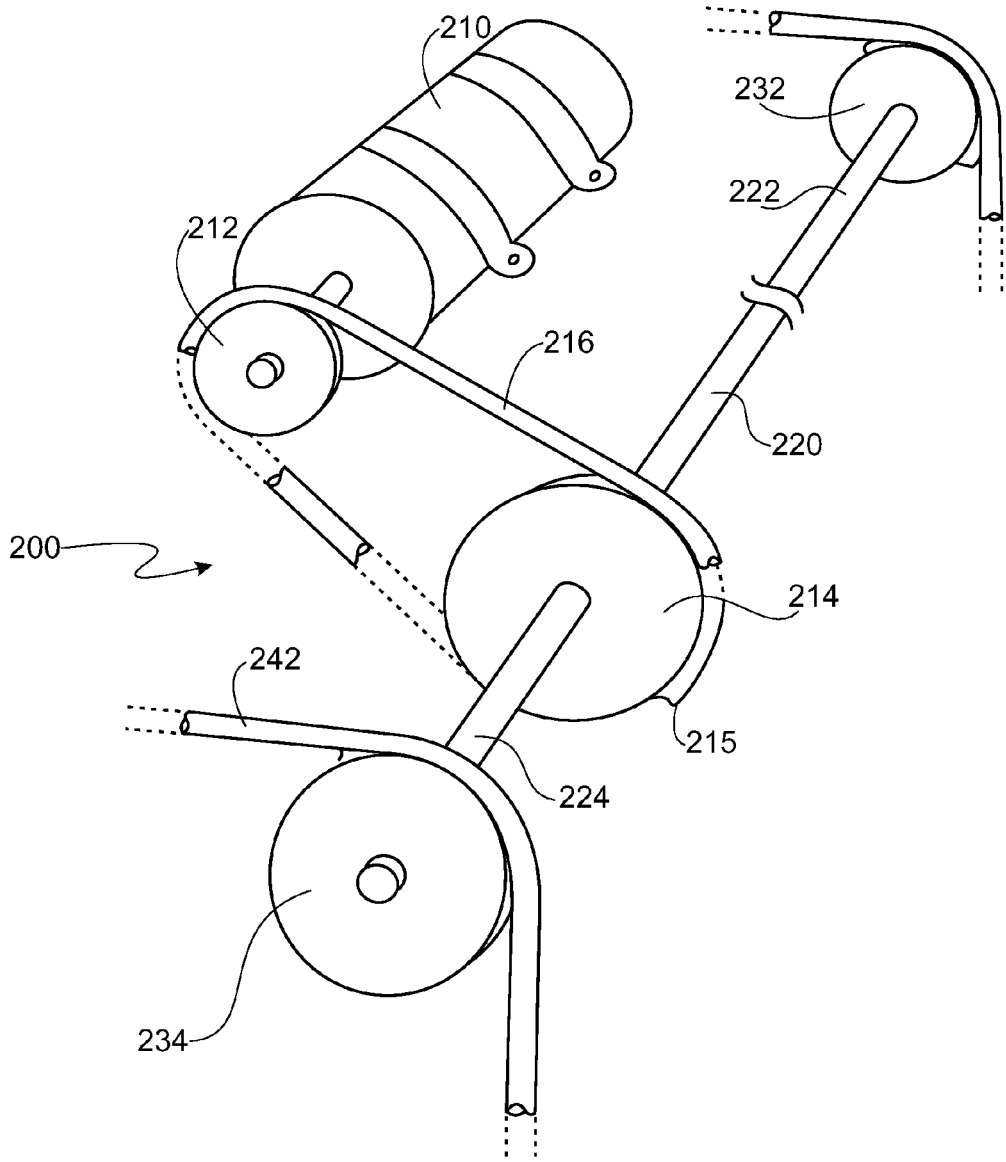
FIG. 4*a* shows an enlarged top perspective view of one alternate embodiment of the anti-cocking drive mechanism shown in FIG. 2.

First forward friction wheel 234, second forward friction wheel 232, first rear friction wheel 235, and second rear friction wheel 233 are not shown as any particular type in FIG. 2. Rather, FIG. 2 is intended to show their positions on fume hood 100 in one embodiment in which second drive wheel 214 engages drive shaft 220. Alternate configurations will be shown infra. FIGS. 3 and 4*a* show two specific embodiments of the specific types of drive wheels 212, 214 and friction wheels 232, 233, 234, 235 that can be used. The embodiment shown in FIG. 2 also shows first rear friction wheel 235 and second rear friction wheel 233 connected by second drive shaft 221. However, this is not necessary as first rear friction wheel 235 and second rear friction wheel 233 can be supported by a brackets attached to the top of fume hood 100 and mechanically coupled only to first flexible coupling 242 and second flexible coupling 241, respectively.

In an alternate embodiment of anti-cocking drive mechanism 200, motor 210 is further comprised of a clutch (not shown). By using a clutch, motor 210 is decoupled from flexible coupling 216, allowing a reduction in the burden and allowing movable sash member 110 to be manually raised and lowered with less force.

Referring to specific embodiments of the invention, FIG. 3 shows an enlarged top perspective view of one embodiment of anti-cocking drive mechanism 200 of FIG. 2, in which one example of motor 210 can be seen. In this embodiment, motor 210 is a gear motor using a gear drive. Motor flexible coupling 216 is a chain, into which teeth 260 on second drive wheel 214 and teeth 261 on first drive wheel 212 fit within holes 217 of motor flexible coupling 216, creating a mechanical engagement so that as motor 210 rotates first drive wheel 212, second drive wheel 214 is driven, which in turn rotates drive shaft 220, which rotates first forward friction wheel 234 and second forward friction wheel 232 simultaneously, as described herein. First flexible coupling 242 is also a chain which corresponds with and fits on teeth 262 of first forward friction wheel 234. Similarly, second flexible coupling 241 is also a chain and teeth 263 of second forward friction wheel 232 fit within corresponding holes in second flexible coupling 241.

In the embodiment shown, the ratio of the diameters between first drive wheel 212 and second drive wheel 214 is 1:2. One of ordinary skill in the art will recognize that any ratio can be used to control the speed of the ascent and descent of the movable sash member and will depend on the manufacturer's preference and the motor used.

Figure 4B:
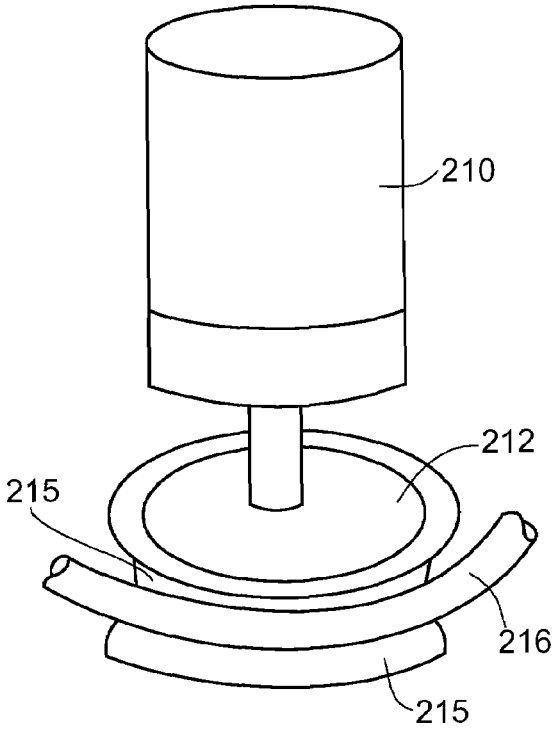
FIG. 4*b* shows a close-up view of the embodiment of the first drive wheel shown in FIG. 4*a*.

FIG. 4*a* shows an enlarged top perspective view of an alternate embodiment of the anti-cocking drive mechanism shown in FIG. 2, and FIG. 4*b* shows a close-up view of the embodiment of the first drive wheel 212 shown in FIG. 4*a* in which an alternate engagement mechanism between first drive wheel 212, second drive wheel 214, first forward friction wheel 234, and second forward friction wheel 232 and between motor flexible coupling 216, first flexible coupling 242, and second flexible coupling 241 is used. In this embodiment, first drive wheel 212, second drive wheel 214, first forward friction wheel 234, and second forward friction wheel 232 are a wheel, and motor flexible coupling 216, first flexible coupling 242, and second flexible coupling 241 are a cable. In one embodiment, the cable is a polypropylene-impregnated cable with a maximum tensile strength of 1700 pounds of force. However, in alternate embodiments, motor flexible coupling 216, first flexible coupling 242, and second flexible coupling 241 can also be coated or uncoated rope, coated or uncoated wire rope, or any other material known in the art that provides sufficient strength and flexibility. The same mechanics are employed as with the embodiment shown in FIG. 3, but rather than using a combination of teeth and corresponding holes on the chain, i.e., a chain and sprocket arrangement, as in the embodiment shown in FIG. 3, motor flexible coupling 216 frictionally engages first drive wheel 212 and second drive wheel 214, first flexible coupling 242 frictionally engages first forward friction wheel 234, and second flexible coupling 241 frictionally engages second forward friction wheel 232. In one embodiment, as shown in FIG. 4*a*, to increase the friction between motor flexible coupling 216 and first drive wheel 212 and second drive wheel 214, the inner surfaces of first drive wheel 212 and second drive wheel 214, designated 215, are coated with a urethane coating, creating a high coefficient of friction therebetween.

Figure 4C:
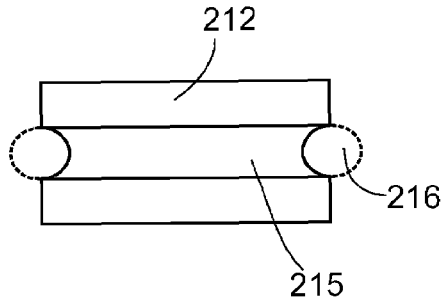
FIG. 4*c* shows a side view of the first drive wheel shown in FIGS. 4*a* and 4*b*.

FIGS. 4*b* and 4*c* shows a side perspective view and a side view, respectively, of first drive wheel 212 shown in the embodiment of anti-cocking drive mechanism 200 shown in FIG. 4*a*, to illustrate the frictional engagement used instead of using a chain and teeth. The reader should understand that the frictional engagement shown in FIGS. 3 and 4*a* can also be used between first flexible coupling 242 and first rear friction wheel (not shown), as well as between second flexible coupling 241 and second rear friction wheel (not shown).

Referring again to FIG. 2, whichever engagement mechanism is used for first flexible coupling 242 (i.e., chain and sprocket, drive wheel and cable, etc.), in order to ensure that movable sash member 110 is raised evenly on both sides, the same engagement mechanism should be used for second flexible coupling 241 so that first flexible coupling 242 and second flexible coupling 241 flex and stretch evenly, preventing the uneven raising and lowering of movable sash member 110. However, this is not necessary. Similarly, one of ordinary skill in the art will recognize that the engagement mechanism employed at first flexible coupling 242 need not also be employed by motor flexible coupling 216. That is, second flexible coupling 241 could be the same as is used by first flexible coupling 242, or that two different flexible couplings could be used. Furthermore, whether the engagement mechanism used at first flexible coupling 242 is the same as that used at second flexible coupling 241, the engagement mechanism used at motor flexible coupling 216 between first drive wheel 212 and second drive wheel 214 could be the same or different as well.

Figure 5:
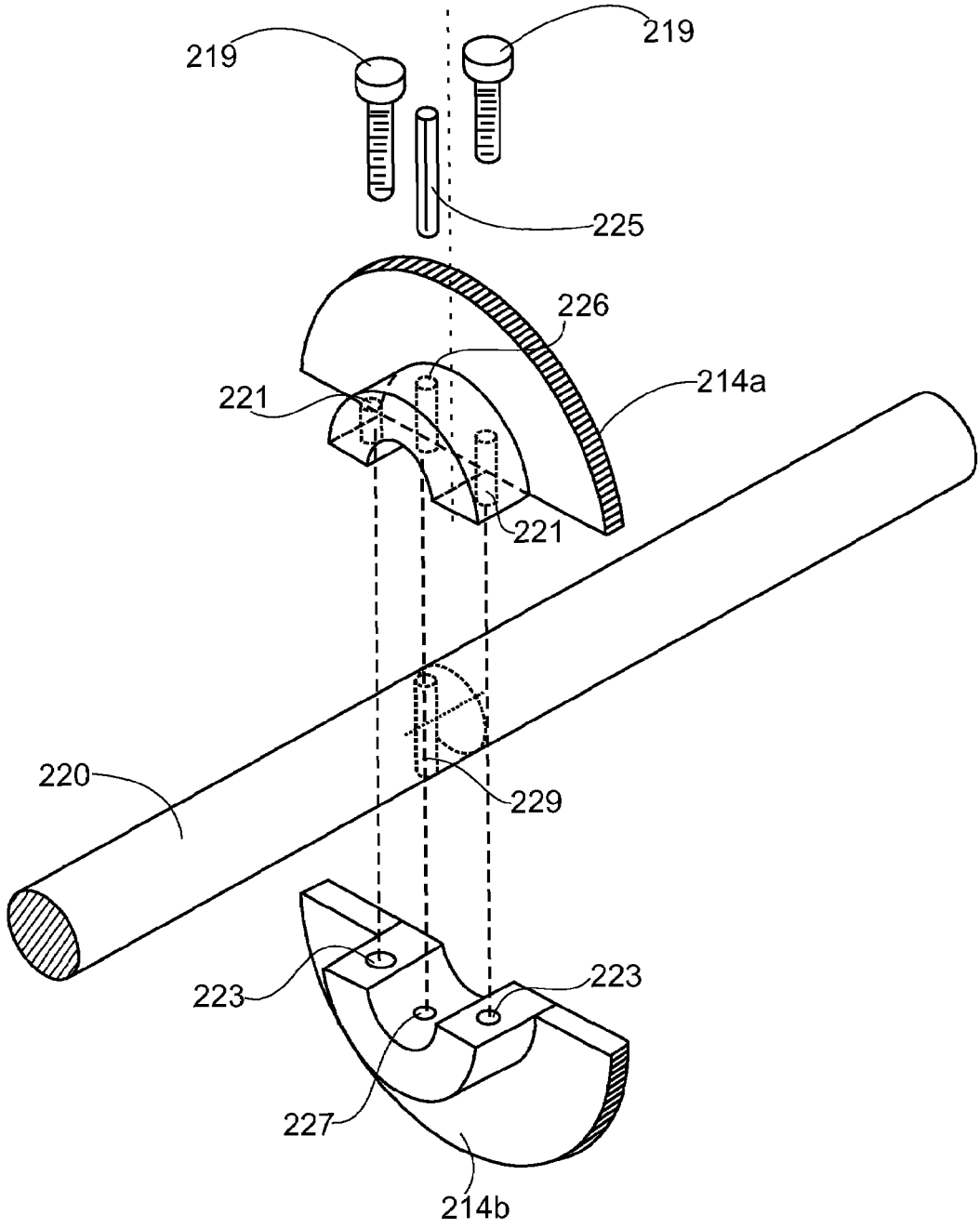
FIG. 5 shows one embodiment of how the second drive wheel is fixedly secured to the shaft.

FIG. 5 is a perspective view of one embodiment of the mechanism used to secure second drive wheel 214 to drive shaft 220. Second drive wheel 214 is comprised of two halves 214*a* and 214*b*. First half 214*a* is placed over drive shaft 220 and secured to second half 214*b* via two fasteners 219 which penetrate throughholes 221 on first half 214*a* and into receiving holes 223 on second half 214*b*. Shear pin 225 is inserted into throughhole 226 on first half 214*a*, through hole 229 in drive shaft 220, and into receiving hole 227 on second half 214*b*. This particular embodiment allows for easy assembly in the field on assembled fume hoods (not shown in FIG. 5) without having to remove drive shaft 220 from the bearing mounts.

In an alternate embodiment, second drive wheel 214 is made of two pieces, but secured to drive shaft 220 by welding, soldering, adhesive, set screws, or any other means known to those of ordinary skill in the art. In another alternate embodiment, second drive wheel 214 is constructed of one piece and drive shaft 220 is slid through a hole in the middle of second drive wheel 214 in the assembly process. Second drive wheel 214 is then secured to drive shaft 220 using any of the mechanisms provided supra or others known to those of ordinary skill in the art. In yet another alternate embodiment, drive shaft 220 and second drive wheel 214 are constructed as one integral unit such that second drive wheel 214 does not have to be secured to drive shaft 220. These alternate securing mechanisms can be used in the initial construction of the fume hood or for field assembly (i.e., retrofitting a fume hood).

The same securing mechanisms for securing second drive wheel 214 to drive shaft 220 can also be used to secure first forward friction wheel 234 to first end 224 of drive shaft 220 and second forward friction wheel 232 to second end 222 of drive shaft 220. That is, first forward friction wheel 234 and second forward friction wheel 232 can each be secured to drive shaft 220 by any of the mechanisms provided supra or constructed as one integral unit.

Figure 6:
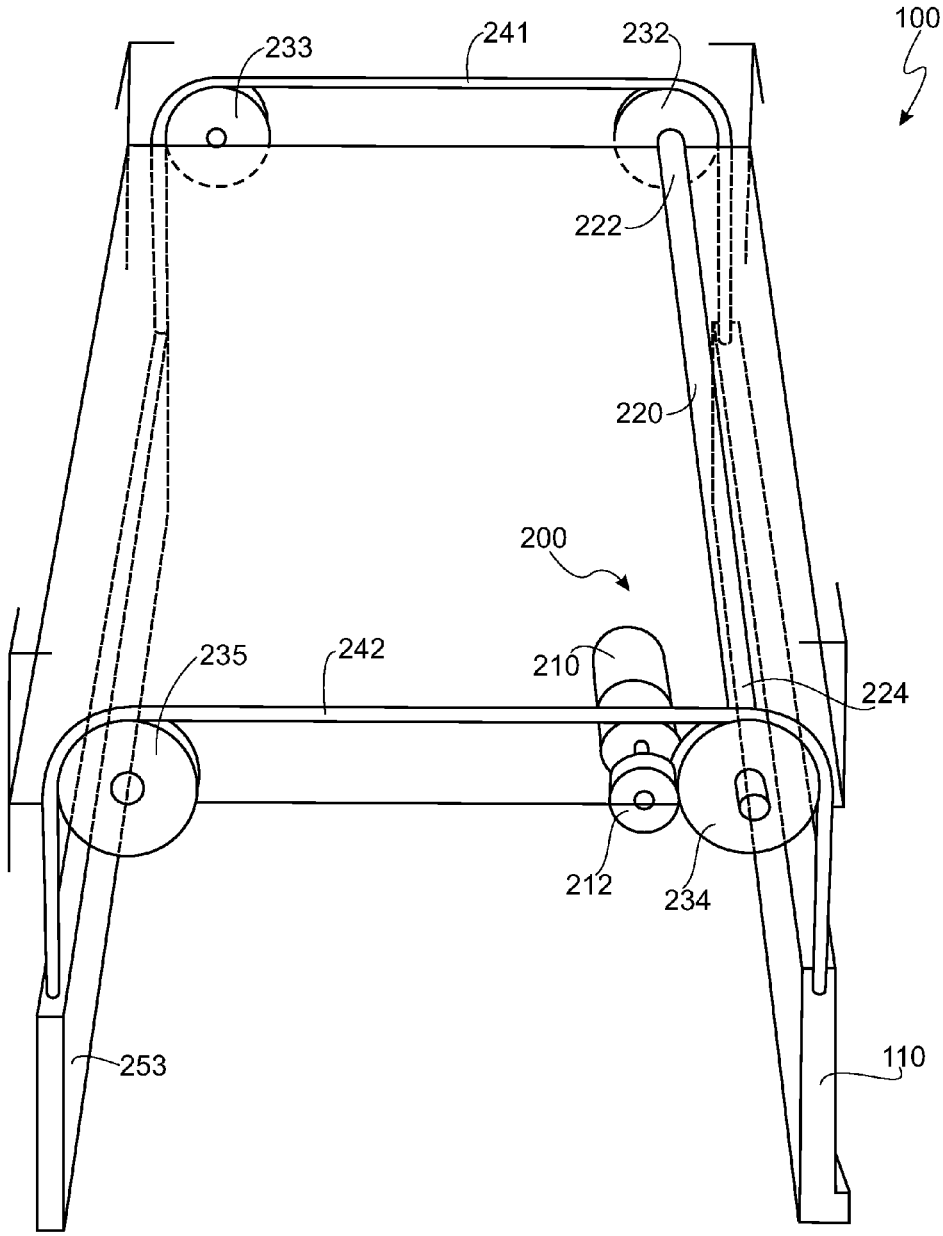
FIG. 6 shows a top side view of an alternate embodiment of the anti-cocking drive mechanism in which the motor is coupled directly to a forward friction wheel.

FIG. 6 is a top perspective side view of fume hood 100 which shows an alternate embodiment of anti-cocking drive mechanism 200 in which motor 210 is mechanically coupled directly to first forward friction wheel 234, making use of a motor flexible coupling and a second drive wheel unnecessary. As in the embodiment shown in FIG. 2, the driving mechanism produces the simultaneous rotation of first forward friction wheel 234 and second forward friction wheel 232, but using an alternate driving mechanism. Motor 210, as with the embodiment shown in FIG. 2, rotates first drive wheel 212. However, in this embodiment first drive wheel 212 of motor 210, instead of engaging drive shaft 220 through a second drive wheel, engages and rotates first forward friction wheel 234 directly. Drive shaft 220 is mechanically coupled to first forward friction wheel 234 as well as to second forward friction wheel 232 so that, as with the embodiment shown in FIG. 2, first forward friction wheel 234 and second forward friction wheel 232 rotate evenly and simultaneously. As explained supra, first forward friction wheel 234 engages first flexible coupling 242, which is connected to single counterweight 253 on one end and to movable sash member 110 on the other end. Second forward friction wheel 232 engages second flexible coupling 241, which is also connected to single counterweight 253 on one end and to movable sash member 110 on the other end. Thus, as motor drives first forward friction wheel 234, first forward friction wheel 234 and second forward friction wheel 232 rotate evenly, and the two ends of movable sash member 110 are raised and lowered simultaneously and at identical speeds, preventing cocking of movable sash member 110. As with the embodiment of anti-cocking drive mechanism described with respect to FIG. 2 the speed at which movable sash member 110 is raised or lowered can be controlled by choosing an appropriate speed of motor 210 or by an appropriate ratio of diameters between first drive wheel 212 and first and second forward friction wheels 234 and 232.

Figure 7:
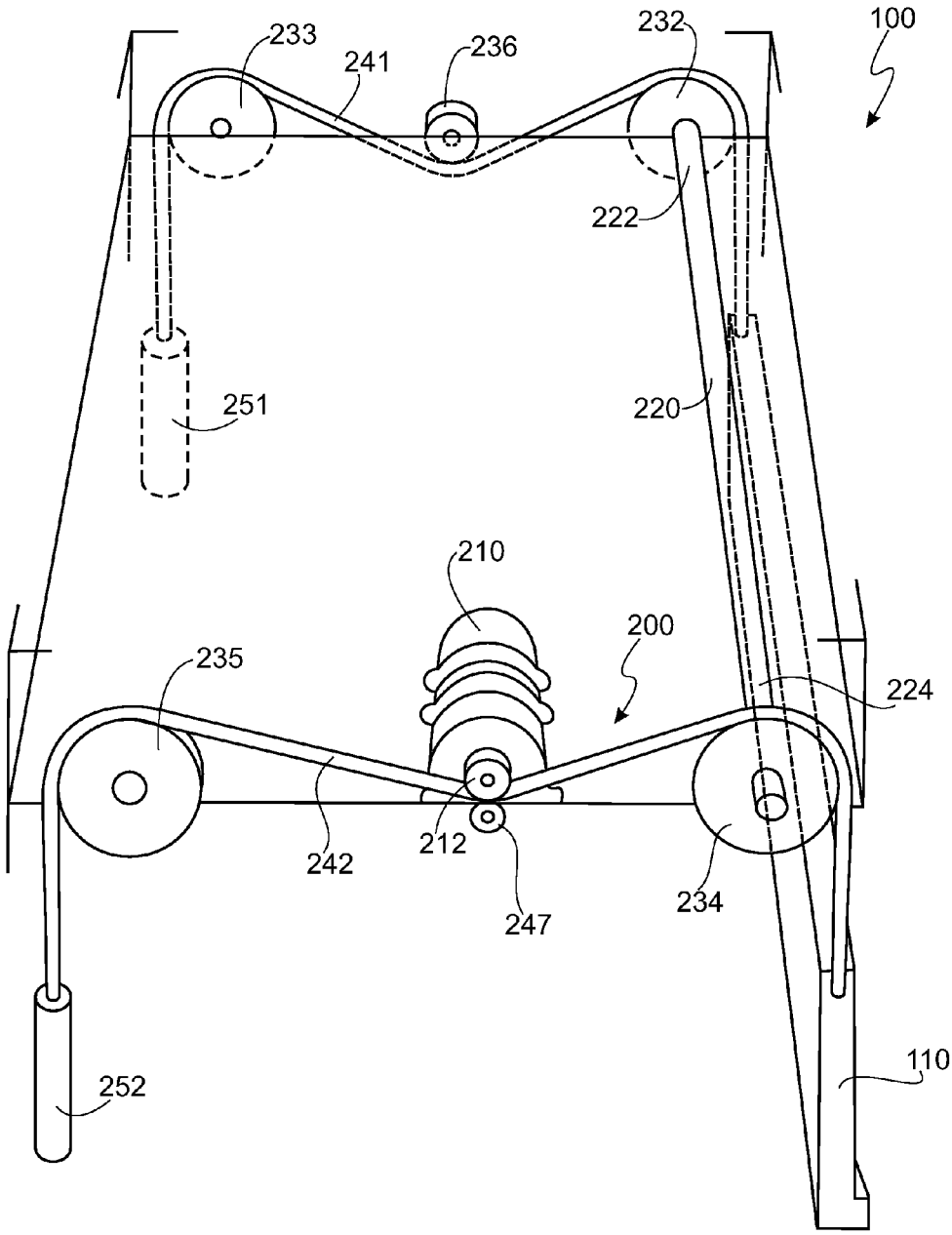
FIG. 7 is a top side view of an alternate embodiment of the anti-cocking drive mechanism in which the motor is coupled a flexible coupling.

FIG. 7 is a top perspective side view of fume hood 100 in which another alternate embodiment of anti-cocking drive mechanism 200 can be seen. In this embodiment, motor 210 is mounted on the top of fume hood 100. Instead of being mechanically coupled to drive shaft 220 (as with the embodiment shown and described in FIG. 2) or to first forward friction wheel 234 (as with the embodiment shown and described in FIG. 6), first drive wheel 212 of motor 210 is mechanically coupled to first flexible coupling 242. As with the embodiment shown in FIG. 6, this particular configuration of anti-cocking drive mechanism 200 does not require the use of the motor flexible coupling. When motor 210 is driven, it rotates first drive wheel 212. First drive wheel 212 engages first flexible coupling 242, which has first counterweight 252 secured to it on one end and one end of movable sash member 110 secured to it on the other end. As motor 210 rotates and first flexible coupling 242 moves, first forward friction wheel 234 and first rear friction wheel 235 are also rotated. First forward friction wheel 234 is coupled to second forward friction wheel 232 by drive shaft 220 so that second forward friction wheel 232 and first forward friction wheel 234 rotate evenly. Second flexible coupling 241 engages second forward friction wheel 232 and second rear friction wheel 233 and is connected to second counterweight 251 on one end and to movable sash member 110 on the other end. Again, because first forward friction wheel 234 and second forward friction wheel 232 rotate evenly, each end of movable sash member 110 is raised and lowered evenly, preventing cocking of movable sash member 110. As with earlier embodiments, the speed at which movable sash member 110 ascends and descends can be controlled by an appropriate size ratio between first drive wheel 212 and first and second forward friction wheels 234 and 232.

As a good engineering practice, the embodiment of anti-cocking drive mechanism 200 shown in FIG. 7 further includes cam roller 247 which pinches first flexible coupling 242 to first drive roller 212. In the embodiment shown, motor 210 is positioned roughly mid-way between first forward friction wheel 234 and first rear friction wheel 235. However, as motor 210 is positioned closer to either first forward friction wheel 234 or first rear friction wheel 235, the likelihood of first flexible coupling 242 slipping off of first drive wheel 212 decreases, making cam roller 247 less necessary, until first drive wheel 212 pinches first flexible coupling 242 against either first forward friction wheel 234 or first rear friction wheel 235, in which a separate cam roller 247 is unnecessary.

Also visible in FIG. 7 is evening sprocket 236. In the embodiment shown in FIG. 7, first flexible coupling 242 passes under first drive wheel 212 of motor 210. This allows for a greater amount of contact between first flexible coupling 242 and first forward friction wheel 234, first drive wheel 212, and first rear friction wheel 235. One of ordinary skill in the art will recognize that first flexible coupling 242 can also pass over first drive wheel 212 if motor 210 is positioned higher on the roof of fume hood 100. Furthermore, a series of sprockets can be placed along the path of first flexible coupling 242, creating a serpentine path in which first flexible coupling 242 has an even greater amount of surface area in contact with the various wheels, further decreasing the chance of slippage. However, to ensure that both sides of movable sash member 110 raise and lower evenly, a similar serpentine path should be created for second flexible coupling 241. To that end, in the embodiment of anti-cocking drive mechanism 200 shown in FIG. 7 in which first flexible coupling 242 passes under first drive wheel 212 of motor 210, evening sprocket 236 is added to the other side of top surface of fume hood 100 so that the length of second flexible coupling 241 between second forward friction wheel 232 and second rear friction wheel 233 is equal to the length of first flexible coupling 242 between first forward friction wheel 234 and first rear friction wheel 235. Similarly, if a series of sprockets is used to create a serpentine path for first flexible coupling 242, an equal amount of evening sprockets 236 can be used with second flexible coupling 241, or an alternate number of evening sprockets 236 that create a serpentine path of the same length.

Figure 8:
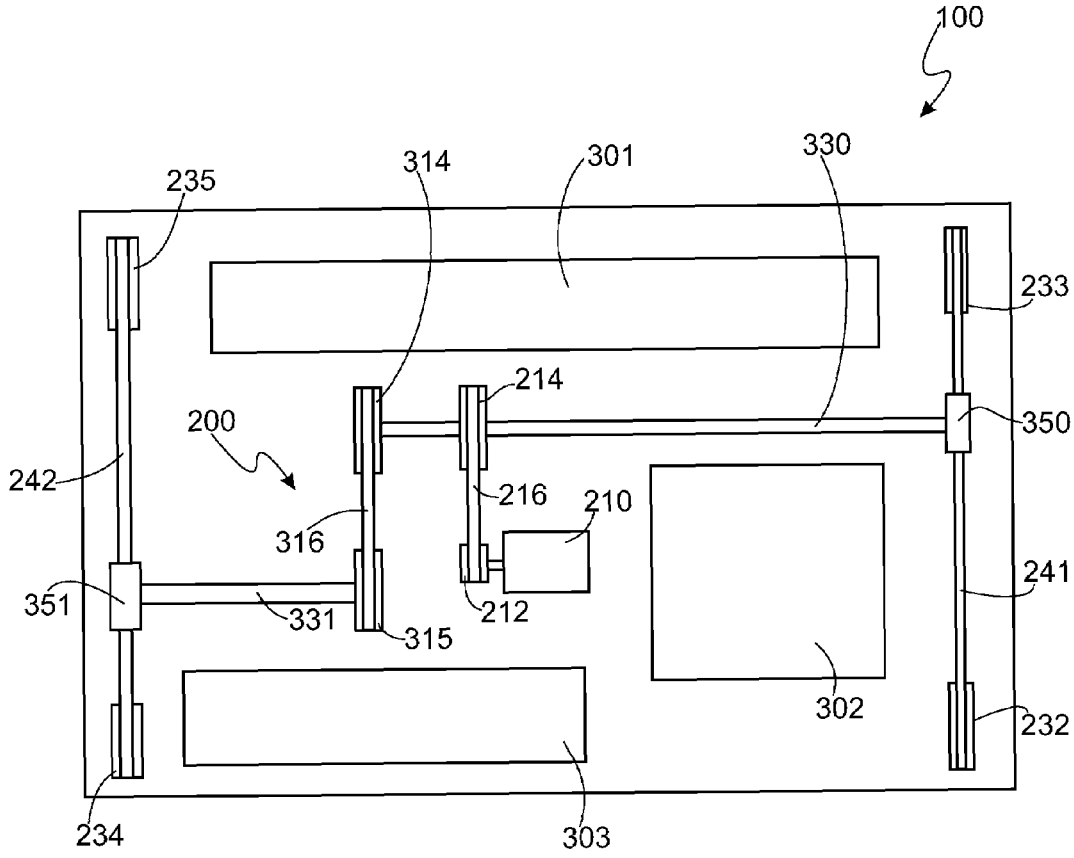
FIG. 8 is a top view of one embodiment of the anti-cocking drive mechanism in which a split shaft is employed.

FIG. 8 is a top view of an alternate embodiment of anti-cocking drive mechanism in which a split shaft is employed. As can be seen obstructions 301, 302, 303 interfere with a single drive shaft being positioned on top of fume hood 100 which can traverse the entire length of fume hood 100 and engage the identical point on the opposite side, whether it is first and second forward friction wheels 234, 232 (as with the embodiments shown and described with respect to FIGS. 2 and 6), first and second rear friction wheels 235, 233, or the same point along first and second flexible couplings 242, 241 (as with the embodiment shown and described with respect to FIG. 7). Instead, a split shaft, comprised of first portion 330 and second portion 331, is employed. In this embodiment, drive motor 210 rotates first drive wheel 212, which further rotates second drive wheel 214 via flexible motor coupling 216. As with earlier embodiments, this rotates first portion 330 of the split drive shaft, which engages friction wheel 350 on a first end, which engages second flexible coupling 241, and raises or lowers the movable sash member (not shown) as described in detail supra. However, on the other end of first portion 330 of the split drive shaft, rather than connecting directly to first flexible coupling 242, first portion 330 of the split drive shaft is connected to third drive wheel 314, which is mechanically coupled to fourth drive wheel 315 via flexible coupling 316. Fourth drive wheel 315 functionally engages second portion 331 of the split drive shaft, which has secured to it friction wheel 351, which engages first flexible coupling 242 to raise and lower the movable sash member.

In yet another embodiment (not shown) of the anti-cocking drive mechanism, the motor is attached directly to the first end of the drive shaft, but outward of the first forward friction wheel. In this embodiment, there is no first drive wheel. Rather, the motor shaft is mechanically coupled directly to the first end of the drive shaft. In addition, as described supra, a clutch can be added to the motor to allow it to disengage the drive shaft such that the movable sash member can be manually raised and lowered.

As stated, for those embodiments in which the movable sash member of the fume hood herein described can also be moved manually, as the movable sash member is raised to a preset height, a limit switch contacts open and removes line power to the motor through open contacts of relays which are normally open. The relay is latched on by its contacts and prevents line power from being restored to the motor by relay contacts. This allows an operator to raise and/or lower the movable sash member to any desired position without the motor engaging when the limit switch re-closes.

As also stated supra, the anti-cocking drive mechanism can be added to existing fume hoods, i.e., retrofitted. The same principles of operation will be employed. That is, a motor is added to a fume hood which employs at least one pair of forward friction wheels connected by a drive shaft. The motor is normally positioned on the top surface of the fume hood, and a first drive wheel of the motor engages the existing flexible coupling, engages the drive shaft via a flexible coupling and a second drive wheel, or engages the first forward friction wheel directly, or the motor is coupled directly to one end of the drive shaft. The remaining principles of operation described supra would thus be used.

While several embodiments of the present invention have been shown and described, it is to be understood that the invention is not limited thereto, but is susceptible to numerous changes and modifications as known to a person skilled in the art, and it is intended that the present invention not be limited to the details shown and described herein, but rather cover all such changes and modifications as are obvious to one of ordinary skill in the art.

What is claimed is:

1. A device comprised of:

a first side wall and a second side wall;

a back wall;

a work surface;

a top wall, said first side wall, said second side wall, said back wall, said work surface, and said top wall defining a work area;

an access opening for providing a user access to said work area;

a movable sash member, said movable sash member comprised of a first end and a second end and disposed for vertical movement across said access opening to vary an effective size thereof;

a drive motor; and an anti-cocking drive mechanism mechanically coupling said drive motor to said movable sash member, wherein said anti-cocking drive mechanism is comprised of:

a first forward friction wheel;

a second forward friction wheel;

a drive shaft connecting said first forward friction wheel to said second forward friction wheel;

a first flexible coupling comprised of a first end and a second end, wherein said first flexible coupling partially wraps around each of said first forward friction wheel and a first rear friction wheel and is mechanically coupled on said first end to said first end of said movable sash member;

a second flexible coupling comprised of a first end and a second end, wherein said second flexible coupling partially wraps around each of said second forward friction wheel and a second rear friction wheel and is mechanically coupled on said first end to said second end of said movable sash member;

wherein said first end and said second end of said movable sash member are raised simultaneously by said drive motor;

wherein said drive motor is further comprised of a first drive wheel and said anti-cocking drive mechanism is a configuration in which said first drive wheel engages said first flexible coupling for rotating said first forward friction wheel, said drive shaft, and said second forward friction wheel simultaneously; and wherein said device further includes at least one evening sprocket for creating a path for said second flexible coupling such that a length of said second flexible coupling between said second forward friction wheel and said second rear friction wheel is substantially equal to a length of said first flexible coupling between said first forward friction wheel and said first rear friction wheel.

2. An apparatus comprised of:

a first side wall and a second side wall;

a back wall;

a work surface;

a top wall, said first side wall, said second side wall, said back wall, said work surface, and said top wall defining a work area;

an access opening for providing a user access to said work area;

a movable sash member, said movable sash member comprised of a first end and a second end and disposed for vertical movement across said access opening to vary an effective size thereof;

a drive motor, wherein said drive motor is further comprised of a first gear, wherein said first gear is further comprised of a series of teeth disposed thereon; and an anti-cocking drive mechanism mechanically coupling said drive motor to said movable sash member, wherein said anti-cocking drive mechanism is comprised of:

a first forward sprocket comprised of a series of teeth disposed thereon;

a second forward sprocket comprised of a series of teeth disposed thereon;

a drive shaft connecting said first forward sprocket to said second forward sprocket;

a first chain comprised of a first end and a second end, wherein said first chain mechanically engages said first forward sprocket and a first rear sprocket and is mechanically coupled on said first end to said first end of said movable sash member;

a second chain comprised of a first end and a second end, wherein said second chain mechanically engages said second forward sprocket and a second rear sprocket and is mechanically coupled on said first end to said second end of said movable sash member;

wherein said first end and said second end of said movable sash member are raised simultaneously by said drive motor;

wherein said anti-cocking drive mechanism is a configuration in which said first gear of said drive motor engages said first chain for rotating said first forward sprocket, said drive shaft, and said second forward sprocket simultaneously; and wherein said device further includes at least one evening sprocket for creating a path for said second chain such that a length of said second chain between said second forward sprocket and said second rear sprocket is substantially equal to a length of said first chain between said first forward sprocket and said first rear sprocket.

3. A sub-assembly to prevent cocking of a fume hood movable sash member comprised of:

a drive motor, wherein said drive motor is further comprised of a first drive wheel;

a first forward friction wheel and a second forward friction wheel;

a drive shaft mechanically coupling said first forward friction wheel to said second forward friction wheel;

a first flexible coupling mechanically engaging said first forward friction wheel and coupled on a first end to a first end of said fume hood movable sash member;

a second flexible coupling mechanically engaging said second forward friction wheel and coupled on a first end to a second end of said fume hood movable sash member; and an anti-cocking drive mechanism, wherein said anti-cocking drive mechanism is comprised of said first drive wheel of said drive motor mechanically engaging said first flexible coupling, wherein as said drive motor is operated, said first flexible coupling is moved and said first forward friction wheel, said drive shaft, and said second forward friction wheel are simultaneously rotated to evenly raise or lower said fume hood movable sash member;

wherein said sub-assembly further includes at least one evening sprocket for creating a path for said second flexible coupling such that a length of said second flexible coupling between said second forward friction wheel and a second rear friction wheel is substantially equal to a length of said first flexible coupling between said first forward friction wheel and a first rear friction wheel.

* * * * *